US010741315B2

(12) United States Patent
Tanada et al.

(10) Patent No.: US 10,741,315 B2
(45) **Date of Patent: *Aug. 11, 2020**

(54) MAGNETIC BODY AND ELECTRONIC COMPONENT USING THE SAME

(71) Applicant: TAIYO YUDEN CO., LTD., Taito-ku, Tokyo (JP)

(72) Inventors: Atsushi Tanada, Takasaki (JP); Kiyoshi Tanaka, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 604 days.

This patent is subject to a terminal disclaimer.

(21) Appl. No.: 14/491,726

(22) Filed: Sep. 19, 2014

(65) Prior Publication Data

US 2015/0083960 A1 Mar. 26, 2015

(30) Foreign Application Priority Data

Sep. 20, 2013 (JP) ..... 2013-195893

(51) Int. Cl.

| | |
|---|---|
| ***H01F 1/147*** | (2006.01) |
| ***B22F 3/24*** | (2006.01) |
| ***C22C 38/34*** | (2006.01) |
| ***C22C 38/06*** | (2006.01) |
| ***H01F 1/24*** | (2006.01) |
| ***H01F 1/33*** | (2006.01) |
| ***C22C 33/02*** | (2006.01) |

(52) U.S. Cl.

CPC ..... *H01F 1/14766* (2013.01); *C22C 33/0257* (2013.01); *C22C 38/06* (2013.01); *C22C 38/34* (2013.01); *H01F 1/24* (2013.01); *H01F 1/33* (2013.01); *B22F 2998/10* (2013.01); *C22C 33/0285* (2013.01); *C22C 2202/02* (2013.01)

(58) Field of Classification Search

None

See application file for complete search history.

(56) References Cited

U.S. PATENT DOCUMENTS 6,661,328 B2 * 12/2003 Inoue ..... H01F 1/24 29/602.1
2007/0169851 A1 * 7/2007 Kugai ..... B22F 1/0088 148/306

(Continued)

FOREIGN PATENT DOCUMENTS

CN 102693801 A 9/2012
JP 2002060914 A 2/2002

(Continued)

OTHER PUBLICATIONS

Machine translation of JP2009-088502A, Apr. 2009.*

(Continued)

*Primary Examiner* — Xiaowei Su
(74) *Attorney, Agent, or Firm* — Law Office of Katsuhiro Arai

(57) ABSTRACT

A magnetic body constituted by magnetic grains bonded together via oxide film, which magnetic grains contain a Fe—Si-M soft magnetic alloy (where M is a metal element more easily oxidized than Fe) that contains sulfur atoms (S). The magnetic body preferably contains 0.004 to 0.012 percent by weight of S, 1.5 to 7.5 percent by weight of Si, and 2 to 8 percent by weight of metal M.

11 Claims, 1 Drawing Sheet

(56) References Cited

U.S. PATENT DOCUMENTS

| | | | | |
|---|---|---|---|---|
| 2012/0188049 | A1* | 7/2012 | Matsuura | B22F 1/02 336/212 |
| 2014/0132383 | A1 | 5/2014 | Matsuura et al. | |
| 2016/0254082 | A1* | 9/2016 | Tanada | C22C 38/34 420/78 |

FOREIGN PATENT DOCUMENTS

| | | | | |
|---|---|---|---|---|
| JP | 2005116820 | A | * | 4/2005 |
| JP | 2006097095 | A | | 4/2006 |
| JP | 2007299871 | A | | 11/2007 |
| JP | 2009088502 | A | * | 4/2009 |
| JP | 2010062424 | A | | 3/2010 |
| TW | 201303918 | A | | 1/2013 |

OTHER PUBLICATIONS

Machine translation of JP2002-060914A, Feb. 2002.*
Machine translation of JP2005116820. (Year: 2005).*
A First Office Action issued by the State Intellectual Property Office of China dated Jul. 4, 2016 for Chinese counterpart application No. 201410482982.2.
A Second Office Action issued by the State Intellectual Property Office of China dated Mar. 21, 2017 for Chinese counterpart application No. 201410482982.2.

* cited by examiner

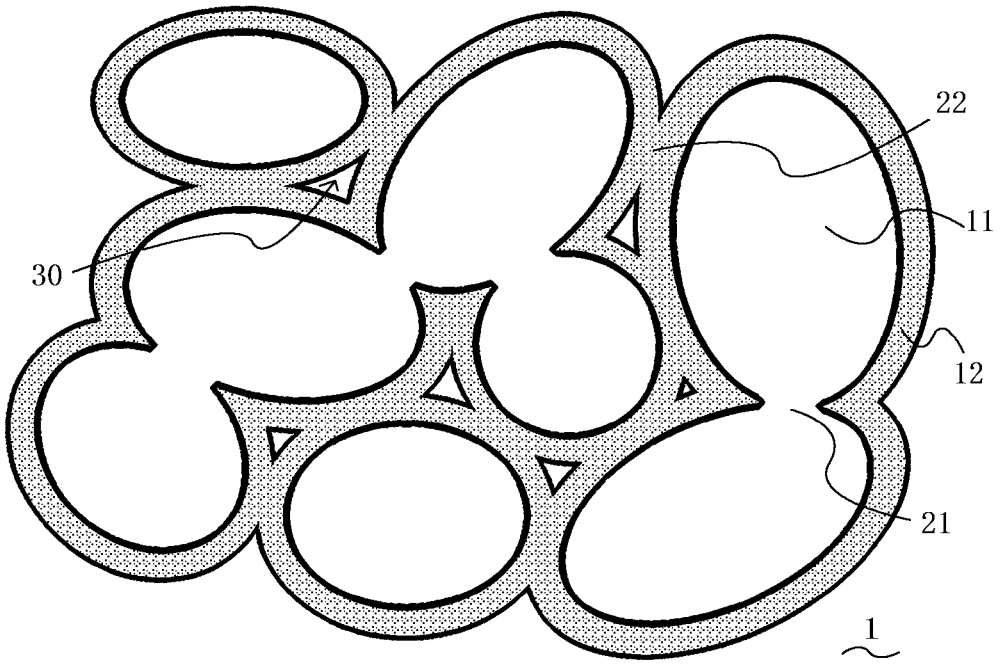
22
11
30
12
21
1

MAGNETIC BODY AND ELECTRONIC COMPONENT USING THE SAME

FIELD OF THE INVENTION

The present invention relates to a magnetic body that can be used primarily as a magnetic core of a coil, inductor or other electronic component, as well as an electronic component using such magnetic body.

DESCRIPTION OF THE RELATED ART

Inductors, choke coils, transformers, and other electronic components (so-called "coil components/inductance components") have a magnetic body constituting their magnetic core, as well as a coil formed in or on the surface of the magnetic body. Ni—Cu—Zn and other types of ferrites are generally used as materials for such magnetic bodies.

In recent years, electronic components of these types are facing a need for larger current (i.e., need to increase their rated current), and to meet this demand, producing their magnetic bodies from Fe—Cr—Si alloy instead of traditional ferrites is being considered. Materials such as Fe—Cr—Si alloy and Fe—Al—Si alloy have higher saturated magnetic flux densities compared to ferrites. On the other hand, their volume resistivities are much lower than those of traditional ferrites.

Patent Literature 1 suggests that, to achieve insulation property and strength, it is important to fill the voids between magnetic materials with glass. Patent Literature 2 describes a process of forming oxide film on the surface of magnetic material, shaping the magnetic material, and then forming oxide film again. To ensure insulation property, it is suggested that making the oxide film thick is important.

BACKGROUND ART LITERATURES

[Patent Literature 1] Japanese Patent Laid-open No. 2010-62424

[Patent Literature 2] Japanese Patent Laid-open No. 2007-299871

SUMMARY

According to the art described in each of the above patent literatures, however, the glass or oxide film must be made sufficiently thick in order to ensure insulation property, which presents an impediment to improving the filling property and consequently limits how much the component size can be reduced.

In light of the above, an object of the present invention is to provide a new magnetic body that can improve both the insulation resistance and filling property, as well as an electronic component using such magnetic body.

Any discussion of problems and solutions involved in the related art has been included in this disclosure solely for the purposes of providing a context for the present invention, and should not be taken as an admission that any or all of the discussion were known at the time the invention was made.

After studying in earnest, the inventors of the present invention completed the present invention as described below:

(1) A magnetic body constituted by bonding together, via oxide film, magnetic grains containing a Fe—Si-M soft magnetic alloy (where M is a metal element more easily oxidized than Fe) that contains sulfur atoms (S).

(2) A magnetic body according to (1), containing 0.004 to 0.012 percent by weight of S.

(3) A magnetic body according to (1) or (2), consists of 1.5 to 7.5 percent by weight of Si, 2 to 8 percent by weight of metal M, as well as S, Fe, oxygen atoms, and unavoidable impurities.

(4) A magnetic body according to any one of (1) through (3), whose apparent density is between 5.7 and 7.2 g/cm$^3$.

(5) A magnetic body according to any one of (1) through (4), wherein the metal M is Cr or Al.

(6) A magnetic body according to any one of (1) through (5), wherein the magnetic grains are manufactured according to the atomization method.

(7) A magnetic body according to any one of (1) through (5), wherein the magnetic grains are manufactured according to the atomization method and S is added in the manufacturing process according to the atomization method.

(8) A magnetic body according to any one of (1) through (7), wherein the oxide film contains an oxide of magnetic grains themselves and the bonding via oxide film is achieved by heat treatment.

(9) An electronic component equipped with a magnetic core that contains a magnetic body according to any one of (1) through (8).

According to the present invention, a magnetic body is provided that offers higher insulation property because sulfur has been added, and thus allows for high-precision forming of electrodes with less plating elongation, even when directly-coupled electrodes are formed. Since the compacting density can be increased while maintaining the same insulation property, the magnetic permeability is expected to improve during heat treatment, which consequently helps reduce the size of the electronic component. It has been confirmed that adding sulfur leads to a manifestation of magnetic permeability improvement effect even at low heat treatment temperatures. Accordingly, a smaller amount of heat is required for heat treatment and therefore the holding time can be reduced while maintaining the same heat treatment temperature, for example, which is expected to lead to a shorter heat treatment time and consequently higher productivity.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1 is a section view providing a schematic representation of the detailed structure of the magnetic body proposed by the present invention.

[Description of the Symbols]

| | |
|---|---|
| 1: Magnetic body | 21: Bond between metal grains |
| 11: Magnetic grain | 22: Bond via oxide film |
| 12: Oxide film | 30: Void |

DETAILED DESCRIPTION OF EMBODIMENTS

The present invention is described in detail by referring to the drawing as deemed appropriate. It should be noted, however, that the present invention is not limited to the embodiment illustrated in any way, and that the scale of each part of the drawing is not necessarily accurate as characteristic parts of the invention may be exaggerated in the drawing.

FIG. 1 is a section view providing a schematic representation of the detailed structure of the magnetic body proposed by the present invention. Under the present invention, a magnetic body 1 is understood, microscopically, as an aggregate of many magnetic grains 11 that bond together but were originally independent, where the individual magnetic grains 11 have oxide film 12 formed almost all around them and this oxide film 12 ensures the insulation property of the magnetic body 1. Adjacent magnetic grains 11 primarily or predominantly bond together via the oxide film 12 present around these magnetic grains 11, thereby constituting the magnetic body 1 having a specific shape (e.g., adjacent magnetic grains are bonded fixedly together via the oxide film without any other intervening layer for bonding). According to the present invention, adjacent magnetic grains 11 may partially bond together via their respective metal parts, as indicated by symbol 21 (e.g., adjacent magnetic grains are bonded fixedly together by direct bonding or metal-to-metal bonding without any intervening layer). Traditional magnetic bodies use a hardened organic resin matrix containing magnetic grains or conjugates of several magnetic grains dispersed in it, or hardened glass constituent matrix containing magnetic grains or conjugates of several magnetic grains dispersed in it. Under the present invention, desirably neither a matrix of organic resin nor a matrix of glass constituent is virtually existent.

Individual magnetic grains 11 are primarily constituted by a specific soft magnetic alloy. Under the present invention, the magnetic grain 11 contains a Fe—Si-M soft magnetic alloy and this alloy further contains sulfur (S) as an essential constituent. Here, M is a metal element more easily oxidized than Fe, typically Cr (chromium), Al (aluminum) or Ti (titanium), among others, and preferably Cr or Al.

The content of Si in the magnetic body 1 is preferably 1.5 to 7.5 percent by weight. A higher content of Si is favored in that it leads to high resistivity and high magnetic permeability, while a lower content of Si leads to good compactibility, and the above preferred range is proposed in consideration of the foregoing.

The content of metal M mentioned above in the magnetic body 1 is preferably 2.0 to 8.0 percent by weight. A higher content of metal M is favored in that it leads to high resistivity and high magnetic permeability, while a lower content of metal M leads to good compactibility. Presence of metal M is favored in that it goes into a passive state during heat treatment, suppressing excessive oxidization and also causing strength and insulation resistance to manifest, while less M is favored from the viewpoint of improving the magnetic characteristics, and the above preferred range is proposed in consideration of the foregoing.

The content of S in the magnetic body 1 is preferably 0.004 to 0.012 percent by weight. High levels of insulation property and magnetic permeability can be achieved simultaneously so long as the content of S is in the aforementioned range, which consequently helps reduce the size of the electronic component.

The remainder of the magnetic body 1, other than Si, metal M, S, and oxygen atoms, is preferably Fe except for unavoidable impurities. The oxygen atoms are primarily those present in the oxide film 12, and their weight is extremely small. Metal elements that can be contained besides Fe, Si, and M include Mn (manganese), Co (cobalt), Ni (nickel), and Cu (copper), among others.

For the magnetic grains, methods of using a mixed powder containing magnetic grains of different compositions and/or magnetic grains of different grain size distributions can also be used.

The chemical composition of the magnetic body 1 can be calculated by, for example, capturing a randomly selected section of the magnetic body 1 using a scanning electron microscope (SEM) and then applying the ZAF method based on energy-dispersive X-ray spectrometry (EDS).

The individual magnetic grains 11 constituting the magnetic body 1 have oxide film 12 formed around them. Oxide film 12 may be formed in the material grain stage before the magnetic body 1 is compacted, or it is possible to keep oxide film non-existent or to a minimum in the material grain stage and produce oxide film in the compacting process. Preferably the oxide film 12 is constituted by an oxide of magnetic grains 11 themselves. In other words, preferably no material is separately added, other than the aforementioned alloy, for the formation of oxide film. Preferably when the magnetic grains are heat-treated before compacting to obtain a magnetic body 1, the surface of magnetic grains are oxidized to produce oxide film 12 and multiple magnetic grains 11 bond together via the oxide film 12 thus produced. Presence of oxide film 12 can be recognized as a contrast (brightness) difference on a scanning electron microscope (SEM) image of 3000 magnifications or so. Presence of oxide film 12 assures the insulation property of the magnetic body as a whole.

With the oxide film 12, preferably the mol ratio of the metal element represented by M above, relative to the Fe element, is greater in the oxide film than that in the magnetic grain 11. Methods to obtain oxide film 12 of such constitution include, among others, keeping Fe oxides to as little as possible or the absolute minimum in the material grain for obtaining the magnetic body and then oxidizing the alloy surface by means of heating, etc., in the process of obtaining the magnetic body 1. Such treatment selectively oxidizes metal M, which is more easily oxidized than Fe, and consequently the mol ratio of metal M to Fe in the oxide film 12 becomes relatively greater than the mol ratio of metal M to Fe in the magnetic grain 11. Containing more of the metal element represented by M, than the Fe element, in the oxide film 12 presents the advantage of suppressing excessive oxidization of alloy grains.

The method of measuring the chemical composition of the oxide film 12 in the magnetic body 1 is explained below. First, the magnetic body 1 is fractured or otherwise its section (randomly selected) is exposed. Next, the surface is made smooth by means of ion milling, etc., and then captured with a scanning electron microscope (SEM), after which the areas of oxide film 12 are calculated by the ZAF method based on energy-dispersive X-ray spectrometry (EDS).

In the magnetic body 1, inter-grain bonds are primarily bonds 22 via oxide film 12. Presence of bonds 22 via oxide film 12 can be clearly determined by, for example, preparing a SEM image enlarged approx. 3000 times, etc., and then visually confirming that the oxide films 12 on adjacent magnetic grains 11 have the same phase. Presence of bonds 22 via oxide film 12 improves the mechanical strength and insulation property. Preferably adjacent magnetic grains 11 bond together via their oxide film 12 throughout the magnetic body 1, but so long as they bond together at least partially, reasonable improvements of mechanical strength and insulation property can be achieved and this is also an embodiment of the present invention. In addition, magnetic grains 11 may partially bond together not via oxide film 12, as indicated by symbol 21. In addition, there may be some areas where adjacent magnetic grains 11 are simply in physical contact or proximity with/to each other, without presence of bonds 22 via oxide film 12 or bonds 21 between magnetic grains 11.

Methods to produce bonds 22 via oxide film 12 include, for example, applying heat treatment at the specified temperature described later in an ambience of oxygen (such as in air) when the magnetic body 1 is manufactured.

Presence of the aforementioned bonds 21 between magnetic grains 11 can be visually confirmed on a SEM image (photograph of section) enlarged approx. 3000 times, for example. Presence of bonds 21 between magnetic grains 11 improves the magnetic permeability.

Methods to produce bonds 21 between magnetic grains 11 include, for example, using material grains having less oxide film, adjusting the temperature and/or partial oxygen pressure during the heat treatment given to manufacture the magnetic body 1 as described later, and adjusting the compacting density applied when obtaining the magnetic body 1 from the material grains.

The alloy composition of the magnetic grain used as the material (hereinafter also referred to as "material grain") will be reflected in the alloy composition of the magnetic body ultimately obtained. Accordingly, any desired alloy composition can be selected for the material grain as deemed appropriate according to the alloy composition of the magnetic body to be ultimately obtained, and preferred ranges of constituents here are the same as the preferred ranges of constituents of the magnetic body as described above.

The sizes of individual material grains are virtually equivalent to the sizes of grains constituting the magnetic body 1 to be ultimately obtained. The size of the material grain, or $d_{50}$, is preferably 2 to 30 μm in consideration of magnetic permeability and in-grain eddy current loss. The $d_{50}$ of the material grain can be measured using a laser refraction/scattering measuring equipment.

Preferably the magnetic grains to be used as the material are manufactured according to the atomization method. Under the atomization method, the primary raw materials including Fe, Cr (ferrochromium), Si, and FeS (iron sulfide) are added and melted in a high-frequency melting furnace. At this time, the weight ratios of primary constituents and weight ratio of S are confirmed. The weight ratio of S is measured according to the combustion infrared absorption method described later. The result is fed back and more FeS is added to adjust the weight ratio of S to the target weight ratio to be ultimately achieved. The material thus obtained is then water-atomized to obtain magnetic grains.

Under the aforementioned combustion infrared absorption method, the measurement sample is heated to high temperature in a high-frequency inductive heating furnace in the presence of pure oxygen flows, and burned. Sulfur dioxide ($SO_2$) obtained from S as a result of this combustion is carried out by the oxygen flows and its amount is measured according to the infrared absorption method. When checked by the inventors of the present invention, this method could also be used to measure the amount of S in the compacted magnetic body, and the composition ratios of elements including S did not change after compacting. Although it is considered that the magnetic grains 11 are partially oxidized when heat treatment is applied during compacting, any changes in weight ratios were imperceptibly small (the overall composition ratios or the composition ratios of inorganic components were substantially unchanged before and after heat treatment).

The method to obtain a compact from the material grains is not limited in any way, and any known means used in the field of grain compact manufacturing can be incorporated as deemed appropriate. The following explains a typical manufacturing method where the material grains are compacted under non-heating conditions and then subjected to heat treatment. The present invention is not limited to this manufacturing method.

Preferably an organic resin is added as a binder when the material grains are compacted under non-heating conditions. For the organic resin, preferably acrylic resin, butyral resin, vinyl resin, or other resin whose thermal decomposition temperature is 500° C. or below is used as it causes less binder to remain after the heat treatment. Any known lubricant may be added at the time of compacting. The lubricant may be an organic acid salt, etc., or specifically zinc stearate or calcium stearate, among others. The amount of lubricant is preferably 0 to 1.5 parts by weight relative to 100 parts by weight of material grains. Zero lubricant means no lubricant is used. A binder and/or lubricant is/are added to the material grains as desired and the mixture is agitated and then compacted to a desired shape. At the time of compacting, 1 to 30 t/cm$^2$ of pressure is applied, for example.

A preferred embodiment of heat treatment is explained.

Preferably heat treatment is performed in an oxidizing ambience. To be specific, the oxygen level during heating is preferably 1% or higher, as it allows bonds 22 via oxide film to be produced more easily. Although not specified in any way, the maximum limit of oxygen level may be the oxygen level in air (approx. 21%) in consideration of manufacturing cost, etc. The heating temperature is preferably 600 to 800° C. in order to make it easy for the magnetic grains 11 to be oxidized themselves to produce oxide film 12, which in turn makes it easy to produce bonds via this oxide film 12. The heating time is preferably 0.5 to 3 hours in order to make it easy to produce bonds 22 via oxide film 12.

The apparent density of the magnetic body 1 obtained by heating is preferably 5.7 to 7.2 g/cm$^3$. The apparent density is measured according to the gas replacement method in compliance with JIS R1620-1995. The apparent density can be adjusted primarily using the compacting pressure mentioned above. So long as the apparent density is within the aforementioned range, high permeability and high resistance are achieved at the same time. The magnetic body 1 can have voids 30 inside.

The magnetic body 1 thus obtained can be used as a magnetic core for various electronic components. For example, an insulation-coated conductor is wound around a magnetic body conforming to the present invention, to form a coil. Or, green sheets containing the aforementioned material grains are formed using any known method, followed by formation of specified patterns on the sheets by printing a conductor paste, etc., after which the printed green sheets are stacked and pressure-compacted and then heat-treated under the aforementioned conditions to obtain an electronic component (inductor) comprising a coil formed in a magnetic body conforming to the present invention. Other than the above, various electronic components can be obtained by using a magnetic body conforming to the present invention as a magnetic core and then forming a coil in or on the surface of the magnetic body. Electronic components of various mounting patterns such as surface-mounted and through-hole mounted components are supported and, as for the means for obtaining an electronic component from a magnetic body, the method described with respect to the examples below may be referenced or any known manufacturing method in the field of electronic components may be incorporated as deemed appropriate.

The present invention is explained more specifically below using examples. It should be noted, however, that the present invention is not limited to the embodiments described in these examples.

(Magnetic Grains)

Magnetic grains were prepared using the atomization method. Under the atomization method, Fe, Cr (ferrochromium), Si, Al, and FeS were used as materials. The compositions and grain sizes of magnetic grains are shown in Table 1. When the compositions were checked by the combustion infrared absorption method, the remainder of the constituents stated in Table 1 was Fe in all cases.

(Manufacture of Magnetic Body)

One hundred parts by weight of these material grains were mixed under agitation with 1.5 parts by weight of acrylic binder with a thermal decomposition temperature of 400° C., after which 0.5 parts by weight of zinc stearate was added as a lubricant. Thereafter, the mixture was compacted into a toroidal shape with the compacting pressure shown in Table 1, and then heat-treated for 1 hour at 650° C. in an oxidizing ambience of 20.6% in oxygen level, to obtain a magnetic body.

TABLE 1

| | Composition [wt %] | | | | Grain size D50 | Compacting pressure |
|---|---|---|---|---|---|---|
| | Si | Cr | Al | S | [μm] | [ton/cm$^2$] |
| Comparative Example 1 | 3.5 | 5.0 | — | — | 10 | 4 |
| Example 1 | 3.5 | 5.0 | — | 0.004 | 10 | 4 |
| Example 2 | 1.5 | 8.0 | — | 0.004 | 10 | 4 |
| Example 3 | 7.5 | 2.0 | — | 0.004 | 10 | 4 |
| Example 4 | 3.5 | 5.0 | — | 0.006 | 10 | 25 |
| Example 5 | 3.5 | 5.0 | — | 0.006 | 4 | 4 |
| Example 6 | 3.5 | 5.0 | — | 0.006 | 30 | 4 |
| Example 7 | 3.5 | — | 5 | 0.006 | 10 | 15 |
| Example 8 | 3.5 | 5.0 | — | 0.012 | 10 | 3 |
| Example 9 | 3.5 | 5.0 | — | 0.012 | 10 | 3 |

(Evaluation)

The composition of each magnetic body was measured using the combustion infrared absorption method to confirm that it directly reflected the composition of the magnetic grain.

Each magnetic body was observed with a SEM to confirm that the magnetic grains were bonded together via oxide film.

The apparent density was measured according to the gas replacement method in compliance with JIS R1620-1995.

For the evaluation of plating property, electrodes of 0.3 mm in length were produced with silver plating on the end faces of magnetic bodies, and those magnetic bodies whose electrodes were elongated to 0.35 mm or more as a result of plating elongation were given evaluation "X"; otherwise, evaluation "0" was given.

During the manufacture of each magnetic body, its magnetic permeability μ was measured before compacting (before heat treatment) and after heat treatment. Those magnetic bodies whose μ after heat treatment was greater by 5% or more than the μ before heat treatment were given evaluation "○"; otherwise, evaluation "X" was given.

The evaluation results are shown in Table 2.

TABLE 2

| | Apparent density [g/cm$^3$] | Plating property | μ evaluation |
|---|---|---|---|
| Comparative Example 1 | 5.71 | x | ○ |
| Example 1 | 5.71 | ○ | ○ |
| Example 2 | 5.73 | ○ | ○ |
| Example 3 | 5.7 | ○ | ○ |
| Example 4 | 7.2 | ○ | ○ |
| Example 5 | 5.71 | ○ | ○ |
| Example 6 | 5.71 | ○ | ○ |
| Example 7 | 5.5 | ○ | ○ |
| Example 8 | 5.51 | ○ | ○ |
| Example 9 | 5.51 | ○ | x |

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" or "an" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2013-195893, filed Sep. 20, 2013, the disclosure of which is incorporated herein by reference in its entirety, for some embodiments.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A magnetic body constituted by magnetic grains bonded together via oxide film, wherein the magnetic grains contain a Fe-Si-M soft magnetic alloy where M is a metal element more easily oxidized than Fe, which alloy contains 0.004 to 0.006 percent by weight of sulfur atoms (S), wherein the magnetic grains consist of Fe, Si, M, S, and oxygen atoms, and an optional metal.

2. The magnetic body according to claim 1, which consists of 1.5 to 7.5 percent by weight of Si, 2 to 8 percent by weight of metal M, as well as S, Fe, and oxygen atoms.

3. The magnetic body according to claim 1, whose apparent density is between 5.7 and 7.2 g/cm$^3$.

4. The magnetic body according to claim 1, wherein the metal M is Cr or Al.

5. The magnetic body according to claim 1, wherein S is dispersed in the Fe-Si-M soft magnetic alloy.

6. The magnetic body according to claim 1, wherein the magnetic grains are bonded fixedly together primarily via the oxide film without any other intervening layer and partially by direct bonding without any intervening layer.

7. The magnetic body according to claim 1, wherein the magnetic grains are manufactured according to an atomization method.

8. The magnetic body according to claim 1, wherein the magnetic grains are manufactured according to an atomization method and S is added in a manufacturing process according to the atomization method.

9. The magnetic body according to claim 1, wherein the oxide film contains an oxide of magnetic grains themselves and bonding via oxide film is achieved by heat treatment.

10. An electronic component equipped with a magnetic core that contains the magnetic body according to claim 1.

11. The magnetic body according to claim 1, wherein the optional metal is at least one metal selected from the group consisting of Mn, Co, Ni, and Cu.

* * * * *